United States Patent [19]

Thomasson

[11] 4,368,824

[45] Jan. 18, 1983

[54] SAFE LOAD INDICATOR

[75] Inventor: William R. Thomasson, Houghton-le-Spring, England

[73] Assignee: Coles Cranes Limited, England

[21] Appl. No.: 149,376

[22] Filed: May 13, 1980

[30] Foreign Application Priority Data

May 18, 1979 [GB] United Kingdom ..... 7917405

[51] Int. Cl.[3] ..... G08B 21/00

[52] U.S. Cl. ..... 212/150; 340/685; 364/424

[58] Field of Search ..... 212/149, 150, 151, 152, 212/153, 154, 155; 364/424, 463; 340/685

[56] References Cited

U.S. PATENT DOCUMENTS 3,922,789 12/1975 Sarrell ..... 212/155 X
4,133,032 1/1979 Spurling ..... 364/424
4,178,591 12/1979 Geppert ..... 340/685
4,185,280 1/1980 Wilhelm ..... 212/150

*Primary Examiner*—Robert B. Reeves
*Assistant Examiner*—Edward M. Wacyra
*Attorney, Agent, or Firm*—Townsend and Townsend

[57] ABSTRACT

A crane having a novel data processing system which uses a microprocessor (22), to calculate mathematically the actual jib radius ($R_1$) from inputs corresponding to jib head angle elevation, jib base elevation and jib length from head (9) to base (8). The system provides actual data which can be fed to a display (10) and which can actuate alarms (24), (26) on reading a safe load stored in a load table in a microcomputer of which the microprocessor forms a part. The actual data can also control motion cut offs, automatic luffing and automatic stowage. A novel dynamometer (30) is also included which can measure crane hoist loads, speed and direction.

21 Claims, 7 Drawing Figures

SAFE LOAD INDICATOR

The present invention relates to a crane having a data processing system.

In existing systems the load on the crane jib is used as one of the parameters or variables for the calculation or determination of actual crane radius. Crane radius is normally indicated in safe load indicators (hereafter abbreviated S.L.I's) and is used to determine actual working load (hereafter abbreviated A.W.L) and safe working load (hereinafter abbreviated S.W.L.). Because load is used as a parameter, the crane calculating system has to be calibrated for specific loads, any slight change of the boom stiffness on cranes of the same type will require a new and different calibration which is expensive, time consuming, crude and subject to error.

Known S.L.I's for cranes have taken into account various variables in crane use, such as jib angle, jib length, crane configuration, slew angle, hoist load and numbers of falls. These variables will hereafter be referred to as crane variables.

Because of the number of variables it has been common practice to measure say hoist load (that is done by several means, one of which is by measuring hoist rope tension by a suitable dynamometer) and jib angle and correlate these variables by means of a cam cut for a particular jib length and crane configuration, the cam being shaped to correspond in proportional manner to a table giving permissible capacity for that length of jib. When a different configuration or jib length is applicable the cam must be changed, and this is troublesome and can be subject to further error. For instance as a load is applied to a jib which is between calibrated positions, the precise working load is determined by the shaping of the cam and this is open to error and lack of consistency between similar machines. Furthermore the cutting of specific cams for each configuration is tedious. With a view to reducing these problems, the variables and cam forms have been represented as electrical resistances and these are compared to detect whether a danger situation exists. Each variable is usually represented on a dial on a main indicator. These systems being in effect analogue computers are inflexible in so far as each variable has to be carefully calibrated and represented by a particular circuit. Therefore changing factors may require a completely new circuit.

According to the present invention a crane has a data processing system comprising means for determining the base angle of the crane jib and the angular deflection of the crane jib head, means for measuring the length from jib base of jib head, the determining means and measuring means being enabled to transmit digital data corresponding to the angular deflection and length determined and measured respectively and a microprocessor arranged to receive signals transmitting such data, to process the data so as to determine mathematically the true deflected form of the crane jib. Actual jib radius may thereby be determined since the actual jib head and base positions are known.

Preferably the microprocessor is connected to a display which is arranged to display A.W.L. and S.W.L. and other data processed by the microprocessor, the display forming a safe load indicator. The microprocessor can be suitably arranged to trigger audible and/or visible alarms and to cut motion when a safe working load is approached or exceeded.

In order to determine a specific load a dynamometer is used.

By using a microprocessor and data inputs, it will be clear that not only can a multiplicity of data be fed into the calculation as to whether a specific load is safe under a certain condition but the number of inputs can be unlimited.

A further advantage is that if equipment is updated it is possible to amend the calculations by reprogramming the microprocessor instead of recutting cams, renewing circuitry or changing permissible duty charts due to change of configurations, that is change to a fly jib or different lattice booms.

The system is able to calculate the actual radius being the apparent radius modified by a specific load. Therefore the safe load indicator is always presented with correct data regarding actual radius at any position and is therefore constantly kept informed of the true safe working situation.

A further advantage not available hitherto is that the same microprocessor can be used for data not specifically related to load, such as tyre pressure, running hours of machinery, time before next maintenance or even maintenance data. No additional hardware is required but only programming.

Thus it will be appreciated that an operator need only refer to one display which can present any information required in an alphanumeric form. A simple analogue display could be incorporated in the form of asterisks with display indicating round numbers or tonnes actual working load and safe working load.

An additional advantage is that when a crane is unloaded but the jib is at a low elevation, provision can simply be made to warn the operator when the jib enters a dangerously low angle that is within the geometric spectrum of the crane but outside the load spectrum.

A still further advantage is that if safety regulations are altered or if the operator moves from one country to another with different safety regulations, these can easily be programmed into the microprocessor without physically altering the indicator, that is changing cams or circuits.

In the event of an automatic luffing or stowing facility being required it is simple to use the data processed by the microprocessor of the system to control servo operated motions for jib length, rope length, jib elevation and slew or height of load.

One embodiment of the invention will now be described in detail, by way of example, with reference to the accompanying drawings in which.

Figure 1:
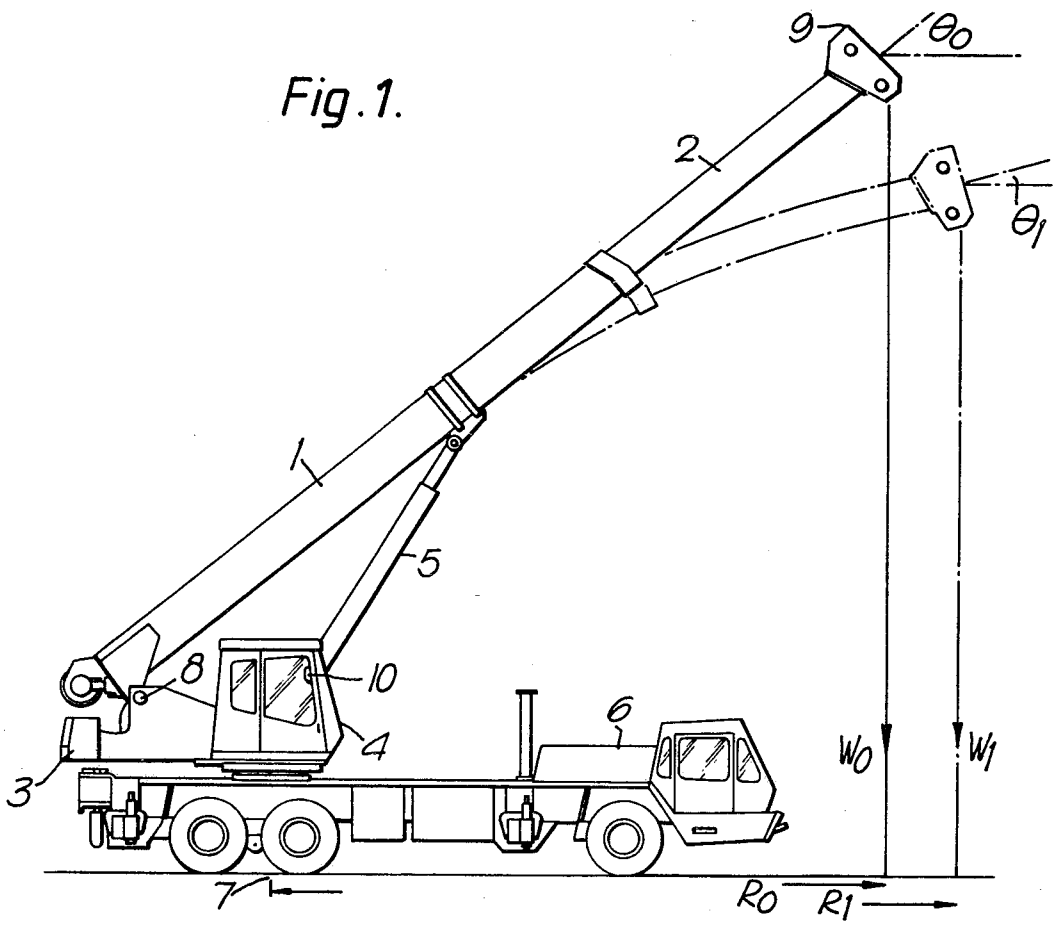
FIG. 1 is an elevation of a vehicle mounted crane incorporating the invention.

The crane shown in the drawing FIG. 1 is one of several suitably provided with a data processing system according to the invention. The crane comprises a telescopic jib lower section 1, one or more extending upper sections 2 with the possibility of a fly jib or other load bearing structure to be fitted thereto, a crane superstructure 3 on which is mounted a cab 4, elevating means 5 (suitably a ram) for elevating the jib, and a vehicle chassis 6. The crane superstructure 3 is mounted to the vehicle 6 so that it can rotate about axis 7.

In a no load state the crane jib head 9 is at an elevation $\theta_o$ which approximately (self weight causing a slight differential) equals that at the crane foot or jib base and can be measured by a suitable detector either close to the jib pivot 8 at the jib base or else in the elevating means 5. In a loaded state represented in considerable over distortion by the broken lines in FIG. 1 the jib head is at an elevation $\theta_1$. The angle $\theta_1$ can be measured by a suitable detector at the head of the boom, other detectors being located at the jib base close to the jib pivot and along the length of the jib (if required) being used to establish the formed shape of the jib. The length of the jib from pivot 8 to head 9 can be measured by suitable means such as a cable running from the jib head to a spring loaded drum at the jib base. The drum is connected to a known digital transmitter. The cable besides measuring jib length is used to power an upper inclinometer 21 at the jib head which detects angle $\theta_1$. Signals from the inclinometer 21 are passed down the cable. The no load radius $R_0$ can then be calculated by a microprocessor provided in the crane and displayed on display 10 mounted in cab 4 and fed with data from the detectors. In the loaded stage the downward deflection of the jib causes the angle of the jib head to reduce to $\theta_1$; also the radius of the jib will increase to $R_1$. Both the deflection and radius are easily indicated digitally on the display 10. Whilst the deflection of the jib has per se a safe limit the increase in radius affects the tendency of the crane to tipping and therefore increase in radius which itself is a variable must be used to modify the load limit for a given radius $R_o$. The reduction of crane variables such as these to digital data clearly ensure the accuracy and effectiveness of the data. On or before reaching any safe limit the microprocessor causes an alarm to sound on an audio alarm 24 and/or a visual alarm on display 10 and a motion cut relay 26 can be made to operate to prevent entering an unsafe condition.

Figure 2:
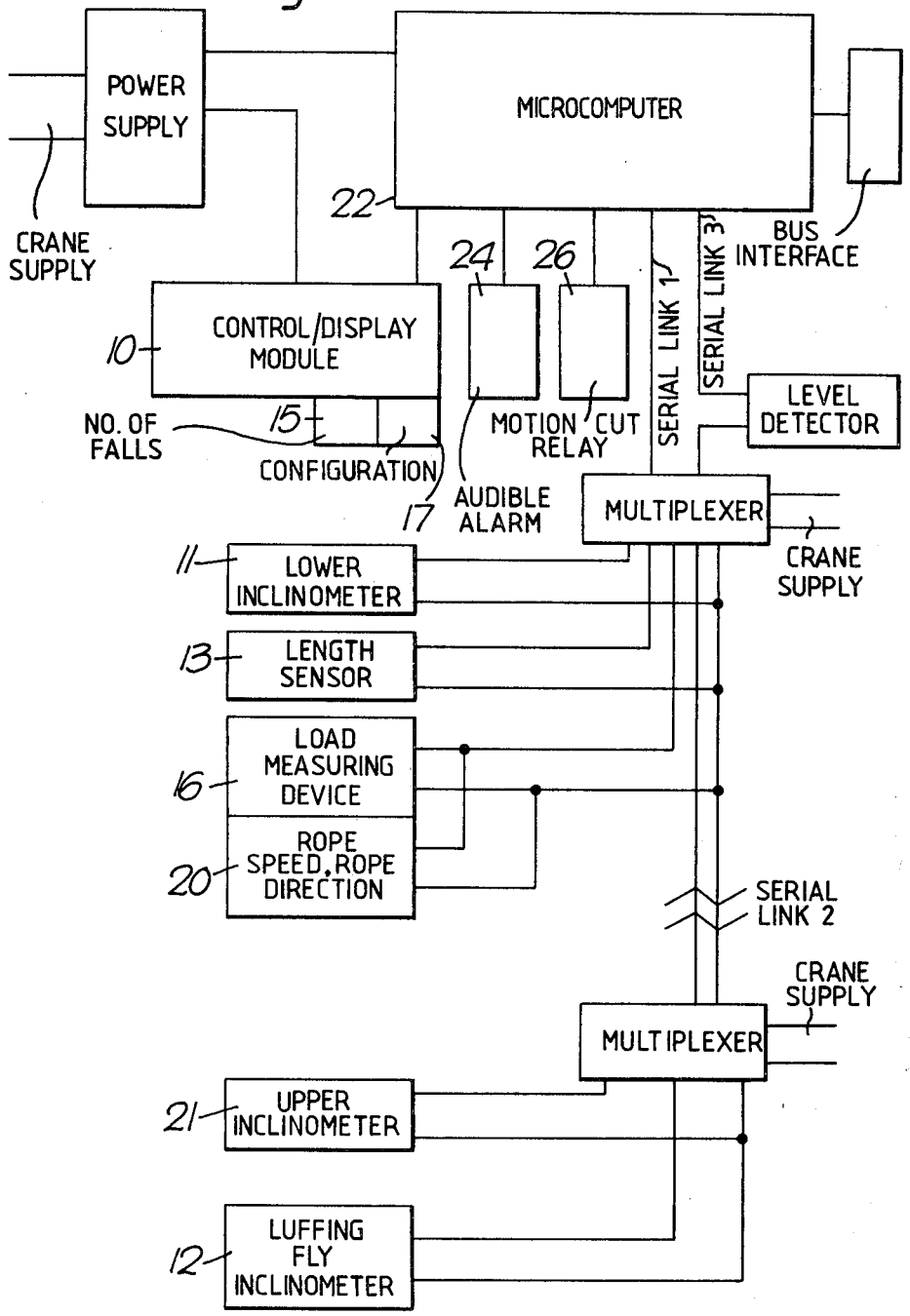
FIG. 2 is a block diagram of a crane data processing system including a safe load indicator according to the invention.

In FIG. 2 the crane data system is diagrammatically shown in which detectors and controls 11 to 21 feed various crane variables to the microprocessor 22 and this feeds in digital form treated data to display 10. In particular, microcomputer 22, powered by the power supply, receives its input signals via serial link 1 and serial link 3. Lower inclinometer 11, length sensor 13, load measuring device 16 and rope speed, rope direction transmitter 20 provide their respective signals along lines to a first multiplexer.

Figure 4:
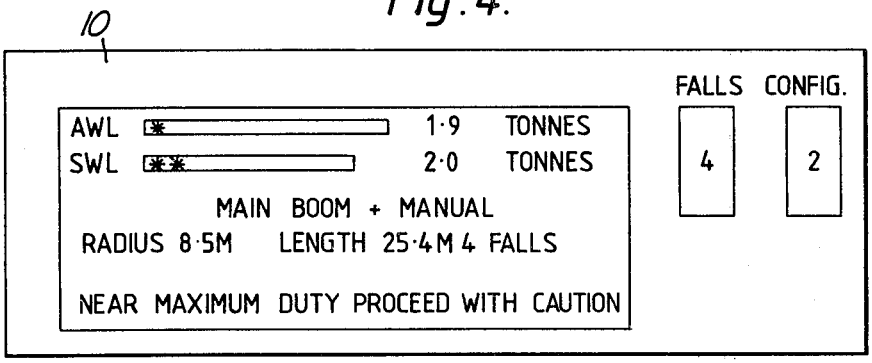
FIG. 4 is a diagram of a display used in the system of FIG. 2.

The upper inclinometer 21 and luffing fly inclinometer 12 are coupled through a second multiplexer to the first multiplexer along serial link 2. Serial link 1 is coupled directly from first multiplexer to microcomputer 22. The serial link 3 couples microcomputer 22 to the first multiplexer through a level detector. Microcomputer 22 provides output signals to audible alarm 24 and motion cut relay 26 as well as display 10. A typical operating display for display 10 is shown in FIG. 4. The number of falls is shown at portion 15 of display 10 while the character representing the configuration is shown at portion 17 of display 10.

Figure 3:
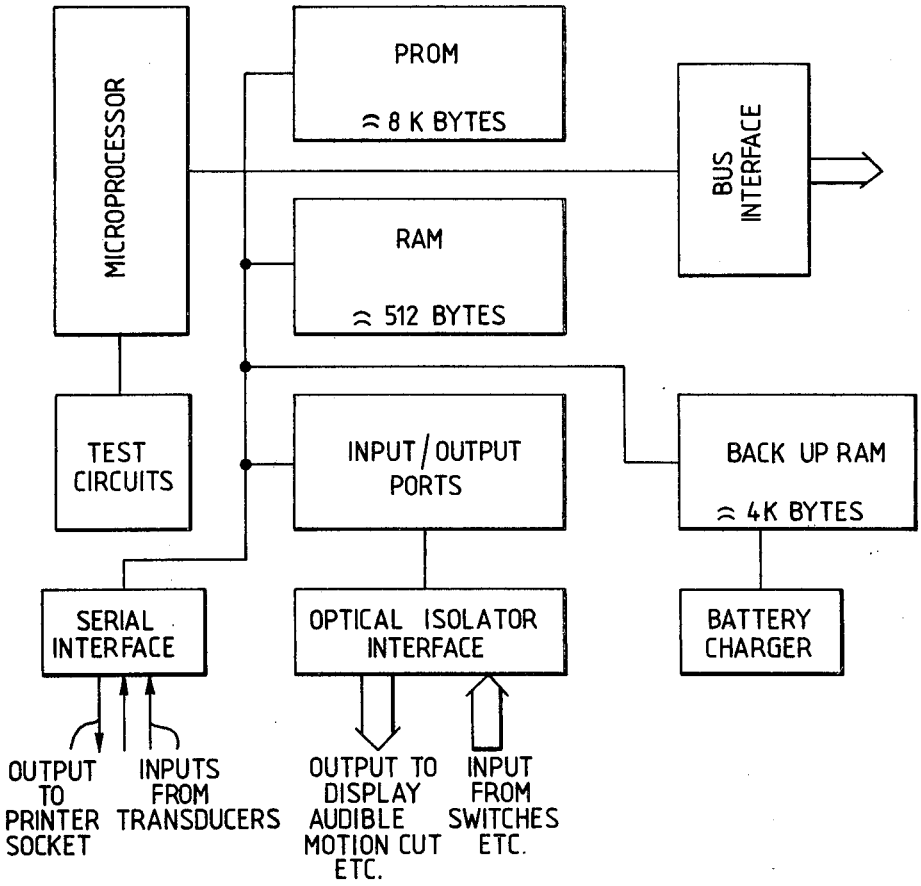
FIG. 3 is a block diagram of details of the microprocessor for the system of FIG. 2.

Turning now to FIG. 3, the basic set-up of microcomputer 22 is shown. The microprocessor is coupled to a programmable read only memory (PROM), a random access memory (RAM), a back-up RAM, input/output ports, a bus interface and a serial interface. The microprocessor is also coupled to the test circuits. The serial interface accepts inputs from the various transducers and provides an output to a printer socket. An optical isolator interface isolates the microprocessor from inputs from switches and so forth and provides optically isolated outputs to display 10, audible alarm 24, motion cut relay 26 and so forth.

Although not shown, it is convenient to use the display 10 for other information such as tyre pressures and engine running hours. Also it could be convenient to use the microprocessor to cause the display to indicate maintenance periods for the whole unit. Thus not only does the invention provide for more accurate processing and display of data, but other data not part of a normal safe load indicator can be stored and displayed.

Although many of the digital transmitters used to transmit data to the microprocessor 10 are known devices certain of these are designed specially for use in the present system. In particular the load measuring device 16 and rope speed and direction transmitter 20 are believed to be novel and are combined in a single detector unit 30 shown in FIGS. 5 to 7.

In the detector 30 which is mounted on the jib between jib head and base there are essentially three rollers or pulleys 31, 32 and 33. Pulleys 31 and 33 lie in line in or parallel to the crane rope 35 and the centre pulley 32 is offset from the line so that it bears against the rope. Any change of rope tension, that is change of load from $W_o$ to $W_1$ causes a tendency for pulley 32 to deflect and this tendency can be measured by a load cell 40. It will be seen in FIG. 5 that each pulley 31 to 33 is mounted respectively in blocks 37 to 39 and each block is connected by thin substantially flexible resilient portions 36 which form part of the same integral member as the blocks 37 to 39 and is formed of an elastomer material such as nylon or Novatron (Registered Trade Mark) a material supplied by Polypenco Ltd. of Welwyn Garden City, England. The thin portions 36 allow centre block 38 to deflect underload with respect to blocks 37 and 39 but have the tendency to reduce any forces acting on the load cell 40 due to friction under motion between rope 35 and pulley 32.

Figure 5:
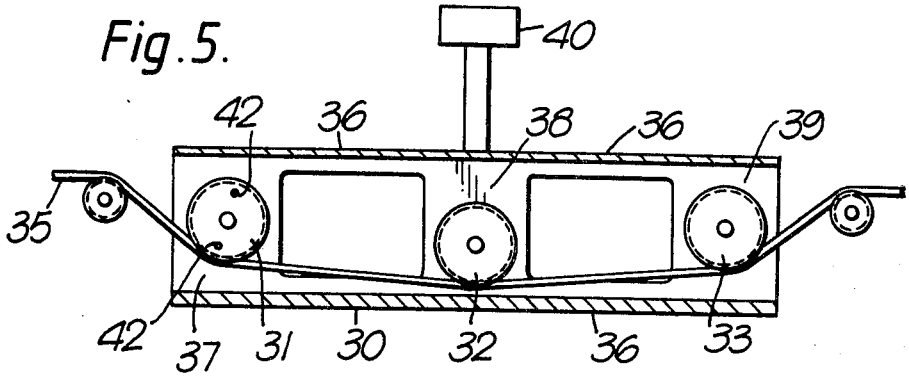
FIG. 5 is a load measuring device and rope speed and direction transmitter for use on the crane shown in FIG. 1.
Figure 6:
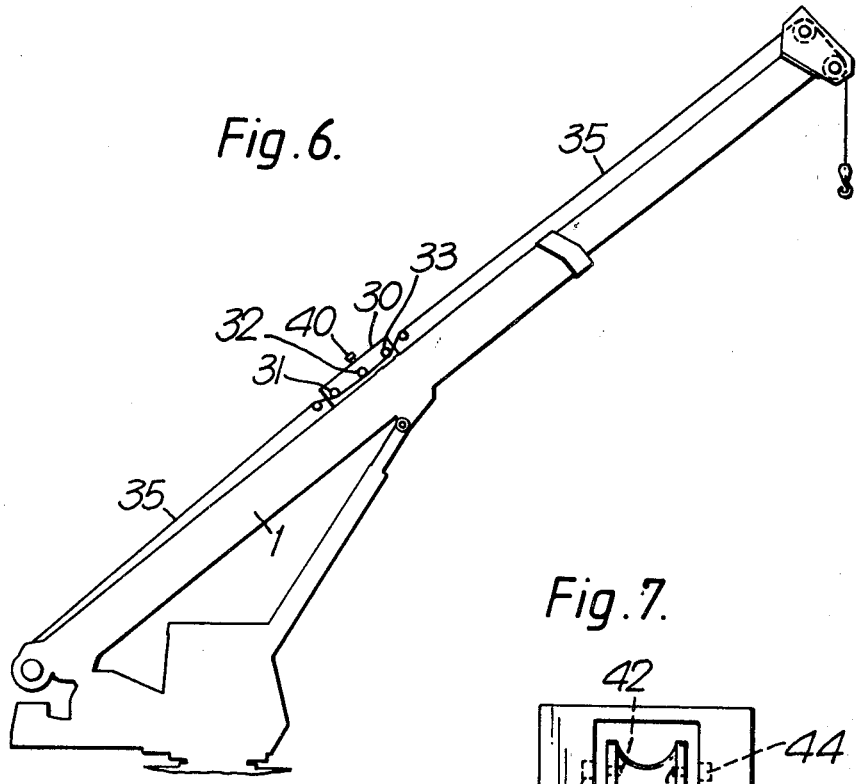
FIG. 6 shows the device and transmitter of FIG. 5 located on the crane of FIG. 1
Figure 7:
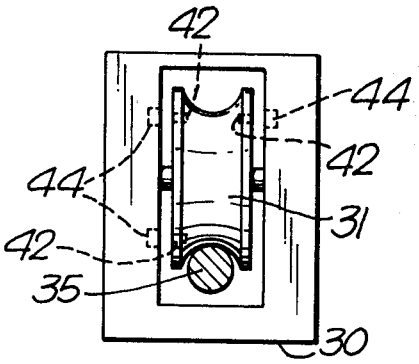
FIG. 7 is another view of the rope speed and direction transmitter of FIG. 5.

In order to transmit the rope motion one of the pulleys in this case pulley 31 is provided with permanent magnets 42 a pair of which are opposite each other in line parallel to the pulley axis and the third being located 180° away from the pair as seen in FIGS. 5 and 7. Sensors 44 are mounted on the unit 30 which digitally transmit pulley ahd hence rope motion to the microprocessor.

Further facilities are available in the system of the invention and indeed the whole system has the advantage of accepting almost any range of data relevant to control, safety, maintenance, operational recording and operation of almost any type of crane.

A particular facility is the provisions of a bus interface on the microprocessor as shown in FIG. 2. This allows one or more programming cards to be linked to the system so that new safety regulations may be added, a recording for "black box" purposes that is for safety records can be constantly made and recording for planned maintenance can be constantly made.

A further facility is that since hoist rope movement, and actual jib head position is determined by the system it is simple to use this data to control servo system connected to slew hoist and jib elevation and length drives to achieve automatic luffing so that the crane operator can programme in the required destination of the load allowing the processor to control the relative movements of the different crane motions.

What is claimed is:

1. A crane with a crane jib having a data processing system comprising, a microprocessor, means for measuring an angle of elevation of said crane jib at the base of said jib, transmitting means transmitting said base angle to said microprocessor, means for measuring an angle of elevation of said crane jib at the head of said jib, transmitting means transmitting said head angle to said microprocessor, means for measuring the length of said jib from jib base to jib head, transmitting means transmitting said length to said microprocessor, said microprocessor being enabled to receive and process data corresponding to said angles and length so as to determine mathematically a true deflected form of said crane jib, whereby actual jib radius can be calculated.

2. A crane as claimed in claim 1 wherein said microprocessor is connected to a display arranged to display data processed by said microprocessor whereby a safe load indication may be displayed.

3. A crane as claimed in claim 1 wherein said crane further comprises audible alarm means, and said microprocessor is arranged to trigger said audible alarm means to give an audible alarm for a safe load indication.

4. A crane as claimed in claim 1 wherein said crane further comprises visual alarm means and said microprocessor is arranged to trigger said visual alarm means to give a visual alarm for a safe load indication.

5. A crane as claimed in claim 1 wherein said crane further comprises crane motion stop means and wherein said microprocessor is arranged to control said stop means when a safe working load is approached.

6. A crane as claimed in claim 1 further comprising:

a dynamometer, said dynamometer being arranged to measure a specific load on the crane hoist rope, transmitting means transmitting digital data corresponding to said measured load to said microprocessor.

7. A crane as claimed in claim 6, said dynamometer comprising a frame, means mounted to said frame tending to deflect said hoist rope from a path under tension caused by said specific load, a load cell mounted to said frame and arranged to measure a force across said hoist rope caused by said deflecting means.

8. A crane as claimed in claim 7 wherein said deflecting means is a second rotatable member mounted to said frame, and wherein first and third rotatable members are mounted to said frame, said hoist rope bearing on said rotatable members, said second rotatable member being out of alignment with said first and third members.

9. A crane as claimed in claim 8 wherein said frame comprises three mounting blocks, each block carrying one of said rotatable members and each block being connected to the other in line by a pair of resiliently flexible members.

10. A crane as claimed in claim 9 wherein said frame is formed of an elastomer material.

11. A crane as claimed in claim 8 wherein one of said rotatable members is provided with indicating means radially spaced from its axis and the frame is provided with detector means arranged to detect the passage of said indicating means past said detector means whereby speed and direction of the rotation of said one rotatable member may be detected, said detector means being enabled to transmit the speed and direction digitally to said microprocessor.

12. A crane as claimed in claim 11 wherein said indicating means comprises at least one magnet.

13. A crane as claimed in claim 12 wherein said indicating means comprises three permanent magnets, two of said magnets being radially spaced adjacent the outer periphery of said one rotatable member and said third magnet radially spaced adjacent the outer periphery of said one rotatable member and at a radially different angle to said other two magnets and preferably but not necessarily diametrically opposite said other two magnets.

14. A crane as claimed in claim 1 wherein said means for measuring the length of said jib from jib base to jib head comprises a cable attached to said jib head, said cable being reeled to a drum at said jib base, said drum being arranged to keep said cable tensioned and said drum being provided with a digital transmitter arranged to transmit drum movement corresponding to jib length to said microprocessor.

15. A crane as claimed in claim 1 wherein said means for measuring an angle of elevation at the head of said jib comprises an upper inclinometer, a signal corresponding to said head angle being compared with said base angle as measured by a lower inclinometer at said jib base.

16. A crane as claimed in claim 15 wherein said means for measuring the length of said jib from jib base to jib head includes a cable attached to said jib head and reeled onto a drum at said jib base, and wherein said head angle signal is fed through the cable.

17. A crane as claimed in claim 1 wherein said microprocessor stores a load table corresponding to permissible loads at specific radii on said crane and which when compared with data received from various transmitters corresponding to crane variables is enabled to stop a crane motion.

18. A crane as claimed in claim 1 wherein said microprocessor is arranged to control servo operated motions for jib length, rope length, jib elevation and slew so as to control the height of a load on the crane hoist rope.

19. A crane as claimed in claim 1 wherein said microprocessor is arranged to control servo operated motions for jib length, hoist rope length, jib elevation and slew angle so as to control the movement of said jib into a stowage position.

20. A crane as claimed in claim 1 wherein said microprocessor stores a load table corresponding to permissible loads at specific radii on said crane and which when compared with data received from various transmitters corresponding to crane variables is enabled to trigger alarms.

21. A crane as claimed in claim 20 wherein said microprocessor is further enabled to stop a crane motion.

* * * * *